United States Patent [19]

Cucalon

[11] 4,026,626

[45] May 31, 1977

[54] DETACHABLE BATTERY CLAMP

[75] Inventor: Ricardo E. Cucalon, Panama City, Panama

[73] Assignee: The Raymond Lee Organization, Inc., New York, N.Y. ; a part interest

[22] Filed: Aug. 30, 1976

[21] Appl. No.: 718,784

[52] U.S. Cl. ..... 339/226

[51] Int. Cl.² ..... H01R 11/26

[58] Field of Search ..... 339/224–240

[56] References Cited

UNITED STATES PATENTS

| | | | |
|---|---|---|---|
| 1,690,310 | 11/1928 | Pieh | 339/230 C |
| 1,713,735 | 5/1929 | Benson | 339/230 C |
| 2,184,807 | 12/1939 | Ahearn | 339/239 |
| 2,962,689 | 11/1960 | Johnson et al. | 339/228 X |

*Primary Examiner*—Roy Lake

*Assistant Examiner*—E. F. Desmond

*Attorney, Agent, or Firm*—Howard I. Podell

[57] ABSTRACT

A battery conductor clamp which may be readily detached from a battery pole. The clamp is in the form of a C-shaped clamp section, shaped to fit about a cylindrical battery pole, the ends of which extend laterally from the clamp section to form a pair of ears which are bolted together to fix the clamp to a cylindrical battery pole. An internal rib projects laterally about the internal cylindrical surface of the clamp section to engage the top surface of the clamped battery pole with an upper section of the clamp section projecting above the internal rib so as to provide a gripping surface for expansion of the clamp, when unbolted, by spreading the jaws of a pliers against the internal projecting surfaces of the clamp section.

2 Claims, 5 Drawing Figures

DETACHABLE BATTERY CLAMP

SUMMARY OF THE INVENTION

My invention is a battery conductor clamp which may be readily detached from a battery pole. The clamp is in the form of a C-shaped clamp section, shaped to fit around a cylindrical battery pole, the ends of which extend laterally from the clamp section to form a pair of ears which are bolted together to fix the clamp to a cylindrical battery pole. An internal rib projects laterally about the internal cylindrical surface of the clamp section to engage the top surface of the clamped battery pole with an upper section of the clamp section projecting above the internal rib so as to provide a gripping surface for expansion of the clamp, when unbolted, by spreading the jaws of a pliers against the internal projecting surfaces of the clamp section.

BRIEF DESCRIPTION OF THE DRAWINGS

The objects and features of the invention may be understood with reference to the following detailed description of an illustrative embodiment of the invention, taken together with the accompanying drawings in which.

DESCRIPTION OF THE PREFERRED EMBODIMENT

Figure 1:
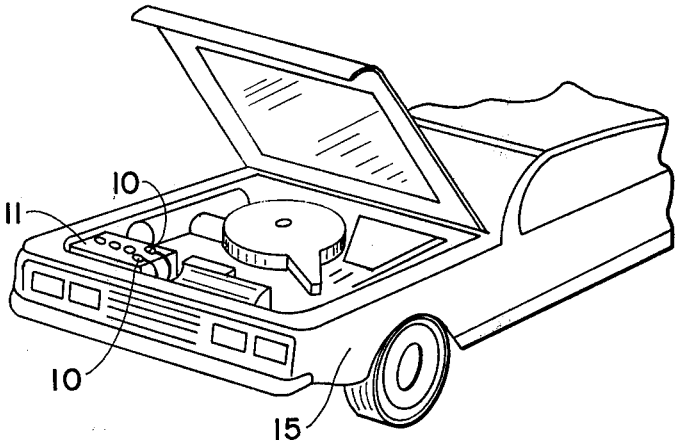
FIG. 1 is a perspective view of the invention in use.
Figure 2:
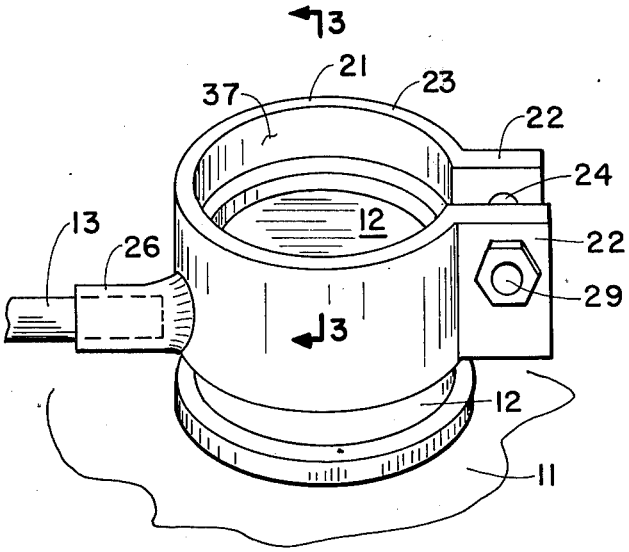
FIG. 2 is a perspective view of the invention.
Figure 3:
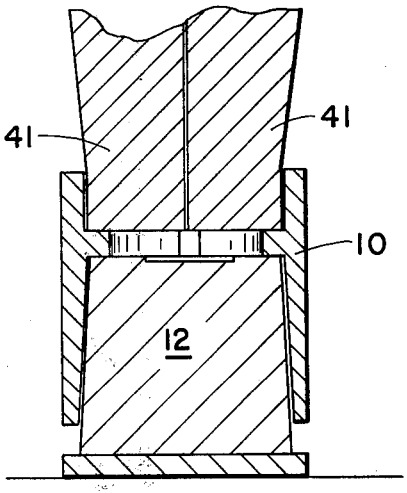
FIG. 3 is a sectional view of the invention prior to opening of the clamp section, taken along line 3—3 of FIG. 2.
Figure 4:
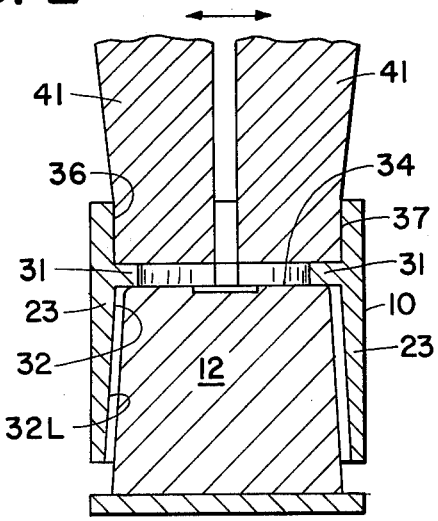
FIG. 4 is a sectional view of the invention after opening of the clamp section.

Turning now descriptively to the drawings, in which similar reference characters denote similar elements throughout the several views, FIGS. 1–4 illustrate the battery clamp 10 of the invention for use in joining an attached cable 13 to a pole 12 of a storage battery 11 commonly employed in a vehicle 15.

Battery clamps are commonly formed of a metal which has properties of high electrical conductivity and consequently has limited spring release action after being clamped about a battery pole 12. Furthermore, corrosion frequently serves to create adhesive action between the clamp and an attached pole so that when the conventional clamp is unbolted, it does not readily release from the battery pole.

The clamp 10 of my invention may be readily released from engagement with a battery pole, after it has been unbolted, by provisions for insertion of the jaws of a pliers into the clamp, with the jaws serving to separate the clamp from the battery pole.

Clamp 10 is formed of a conventional split sleeve section 21, with each free end of a leg 23 bent to form a projecting ear 22 fitted with a hole 24 through which a clamp bolt 25 may be fitted for bolting the ears 22 together by bolt 29 to clamp the split sleeve section 21 about a cylindrical battery pole 12. A hollow lug 26 is externally fixed to the sleeve section 21 for joining to an electrical cable 13.

A rib 31 projects from the internal cylindrical surface 32 of the sleeve section extending radially about the axis of the circular surface 32 so as to fit over the top 34 of an attached battery pole 12, with an upper section 36 of the sleeve section 21 extending beyond rib 31 so that the internal surface 37 of sleeve section 21 may be gripped by the jaws 41 of a pliers to open sleeve section 21 and disengage the clamp 10 from engagement with an attached battery pole 12 after ears 22 have been unbolted by loosening bolt 29.

Rib 31 may be of a continuous form or alternately may consist of one or more detached detents extending from the internal surface 32 of sleeve section 21, so as to separate the internal surface 32 into a lower pole contact area 32L and an upper grip area 37 that is accessible to the jaws of a plier when clamp 10 is fixed about a battery pole 12.

Figure 5:
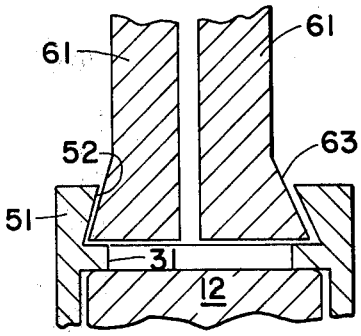
FIG. 5 is a sectional view of an alternate embodiment of the invention.

Alternately, clamp may be formed with a split sleeve 51, shown in FIG. 5, in which the sleeve internal surface 52 extending on one side of rib 31 is tapered with an undercut shape so as to be engageable by jaws 61 of a plier with jaws 61 shaped with an external taper form 63 to matingly engage the undercut taper of surface 52 so as to furnish both a lateral and a longitudinal gripping action of plier jaws 61 when engaging and spreading split sleeve 51.

Since obvious changes may be made in the specific embodiment of the invention described herein, such modifications being within the spirit and scope of the invention claimed, it is indicated that all matter contained herein is intended as illustrative and not as limiting in scope.

Having thus described the invention, what I claim as new and desire to secure by Letters Patent of the United States is:

1. A battery clamp which is readily detached from engagement with a battery pole, comprising a battery clamp in the form of a split sleeve shaped to fit around a cylindrical pole of a battery, said sleeve fitted on its internal surface with a radially projecting detent which divides the internal surface of the sleeve into a contact section that may fit about a battery pole and a grip section that extends beyond the engaged battery pole, said grip section adaptable for being spread apart by the jaws of a plier extended into the grip section.

2. The combination as recited in claim 1 in which the grip section is shaped with an undercut form so as to engage the mating shape of a pair of plier jaws.

* * * * *